US010926997B2

(12) United States Patent
Sever et al.

(10) Patent No.: US 10,926,997 B2
(45) Date of Patent: Feb. 23, 2021

(54) CO-FUELING NOZZLE WITH DUAL SPOUTS

(71) Applicants: John Sever, Villa Ridge, MO (US); Zachary Holcomb, High Ridge, MO (US); Paul Pitney, Ballwin, MO (US); Roger Wiersma, Pacific, MO (US); Derek Willers, Saint Peters, MO (US)

(72) Inventors: John Sever, Villa Ridge, MO (US); Zachary Holcomb, High Ridge, MO (US); Paul Pitney, Ballwin, MO (US); Roger Wiersma, Pacific, MO (US); Derek Willers, Saint Peters, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 16/501,893

(22) Filed: Jun. 27, 2019

(65) Prior Publication Data

US 2019/0330048 A1 Oct. 31, 2019

Related U.S. Application Data

(63) Continuation-in-part of application No. 29/651,311, filed on Apr. 19, 2018, now Pat. No. Des. 882,729.

(60) Provisional application No. 62/763,811, filed on Jul. 2, 2018.

(51) Int. Cl.
*B67D 7/42* (2010.01)
*B67D 7/44* (2010.01)

(52) U.S. Cl.
CPC ..... *B67D 7/428* (2013.01); *B67D 7/44* (2013.01)

(58) Field of Classification Search
CPC ..... B67D 7/428; B67D 7/44; B67D 7/42
USPC ..... 141/392
See application file for complete search history.

(56) References Cited

U.S. PATENT DOCUMENTS 2,818,889 A * 1/1958 Krause ..... B67D 7/48 141/208
2,888,171 A * 5/1959 Turner ..... F16K 31/48 222/47
3,603,359 A * 9/1971 Belue ..... B67D 7/48 141/208
3,817,285 A * 6/1974 Wilder ..... B67D 7/48 137/614.19

(Continued)

OTHER PUBLICATIONS https://www.husky.com/husky/truck-and-high-volume/husky-viii-standard/ (Year: 2019).‡

*Primary Examiner* — Timothy L Maust
*Assistant Examiner* — James R Hakomaki
(74) *Attorney, Agent, or Firm* — Paul M Denk

(57) ABSTRACT

A co-fueling nozzle incorporating dual spouts, having a nozzle housing, a pair of fuel flow paths provided through the housing, a separate poppet and automatic shut off valve operatively associated with each flow path, such that when fuel or additive flows through the various flow paths, it is dispensed out of separate nozzle spouts, when fuel dispensing is initiated. A single actuating lever operates to open or close the poppet valves of the nozzle, and the actuating lever connects with a pair of independent actuators, that engage with their respective poppet valves and automatic shut off valves, to provide for simultaneous or independent opening and closing of the poppet valves, to allow for simultaneous or separate flow of fuel or additives through the nozzle for co-fueling of a vehicle fuel tank or tanks.

6 Claims, 9 Drawing Sheets

(56) References Cited

U.S. PATENT DOCUMENTS 3,938,565 A * 2/1976 Robinson, Jr. ..... B67D 7/50 141/392
3,996,977 A * 12/1976 Hansel ..... B67D 7/48 141/285
D263,618 S ‡ 3/1982 Taylor ..... D23/226
4,351,375 A ‡ 9/1982 Polson ..... B67D 7/48 137/79
D317,969 S ‡ 7/1991 Lambert ..... D23/226
5,085,258 A 2/1992 Fink, Jr. et al.
5,197,523 A ‡ 3/1993 Fink, Jr. ..... B67D 7/0478 141/20
D342,742 S ‡ 12/1993 Daul ..... D23/226
5,289,856 A ‡ 3/1994 Strock ..... B67D 7/0476 141/20
5,325,896 A 7/1994 Koch et al.
5,327,943 A 7/1994 Strock et al.
D350,386 S ‡ 9/1994 Dotson ..... D23/223
D355,704 S ‡ 2/1995 Simpson ..... D23/223
5,419,467 A 5/1995 Maguire et al.
D359,100 S ‡ 6/1995 Dotson ..... D23/223
5,765,609 A 6/1998 Dalhart et al.
5,908,055 A 6/1999 Baumann et al.
D420,908 S ‡ 2/2000 Sumner ..... D9/417
6,105,822 A ‡ 8/2000 Larsen ..... B29B 7/7442 222/13
6,119,896 A 9/2000 Varini
6,158,631 A ‡ 12/2000 Varini ..... B05B 15/652 222/53
6,263,924 B1 * 7/2001 Grosser ..... B67D 7/42 141/102
6,394,151 B1 5/2002 Donaldson et al.
6,460,526 B1 ‡ 10/2002 Ward ..... F02D 41/009 123/61
6,460,562 B1 10/2002 Hart
6,520,383 B1 ‡ 2/2003 Brest ..... A47J 36/06 210/46
6,634,395 B1 ‡ 10/2003 Mitchell ..... B67D 7/42 141/12
6,926,030 B2 ‡ 8/2005 Ricciardi ..... B01F 3/0865 137/60
6,951,229 B2 ‡ 10/2005 Garrison ..... B67D 7/44 141/20
D516,673 S ‡ 3/2006 Chisholm ..... D23/226
D518,556 S ‡ 4/2006 Amaduzzi ..... D23/226
7,082,972 B1 * 8/2006 Healy ..... B67D 7/54 141/192
7,114,523 B2 ‡ 10/2006 Ricciardi ..... B01F 3/0865 137/60
7,134,580 B2 ‡ 11/2006 Garrison ..... B67D 7/48 222/566
D542,139 S ‡ 5/2007 Welter ..... D9/520
7,234,614 B1 ‡ 6/2007 Knight ..... B67D 7/42 137/312
D556,008 S 11/2007 Kerr
D648,417 S 11/2011 Varini
D650,047 S 12/2011 Varini
D656,221 S ‡ 3/2012 Gevers ..... D23/226
D684,664 S ‡ 6/2013 Gevers ..... D23/226
8,631,837 B2 ‡ 1/2014 Lauber ..... B67D 7/48 141/59
D734,427 S ‡ 7/2015 Bygbjerg ..... D23/213
9,260,286 B2 2/2016 Garrison et al.
D769,332 S 10/2016 Varini
D771,715 S 11/2016 Varini
9,534,735 B2 1/2017 Pitney
D782,001 S ‡ 3/2017 Birch ..... D23/211.2
D803,984 S ‡ 11/2017 Tschopp ..... D23/226
9,821,179 B2 ‡ 11/2017 Kristensen ..... B05B 1/14
9,849,775 B2 ‡ 12/2017 Eberhardt ..... B60K 15/04
10,077,145 B1 * 9/2018 Boucher ..... B65D 47/32
D829,862 S ‡ 10/2018 Lee ..... D23/223
D831,158 S ‡ 10/2018 Weh ..... D23/226
D850,582 S ‡ 6/2019 Weinberg ..... D23/226
D852,324 S ‡ 6/2019 Willfort ..... D23/226
D861,264 S ‡ 9/2019 Gu ..... D32/17
2006/0144961 A1 * 7/2006 DeKeyser ..... A01C 5/02 239/398
2012/0018534 A1 ‡ 1/2012 Gilpatrick ..... B05B 7/0876 239/310
2015/0298959 A1 10/2015 Harrell
2016/0083243 A1 ‡ 3/2016 Larsson ..... B67D 7/04 141/1
2016/0347603 A1 * 12/2016 Zammit ..... B60K 15/03
2018/0029872 A1 * 2/2018 Garrison ..... B67D 7/005
2018/0057349 A1 ‡ 3/2018 Wolff ..... B67D 7/04
2018/0304292 A1 ‡ 10/2018 Alexander ..... B05B 12/002
2019/0263654 A1 ‡ 8/2019 Wiersma ..... B67D 7/34
2019/0330048 A1 ‡ 10/2019 Sever ..... B67D 7/44

* cited by examiner
‡ imported from a related application

CO-FUELING NOZZLE WITH DUAL SPOUTS

CROSS REFERENCE TO RELATED APPLICATION

This provisional patent application claims priority to the design patent application having Ser. No. 29/651,311, filed on Apr. 19, 2018.

FIELD OF THE INVENTION

This invention relates to the field of fuel dispensing, and more specifically, pertains to a gasoline or other fuel dispensing nozzle, that incorporates dual flow lines through its nozzle housing and handle, having individual poppet valves and automatic shut off valves operatively associated with each flow line, and each flow line having its own independent fuel dispensing spout integrally structured extending from the front of the nozzle housing, and for the dispensing of separate fuels or additives, into one or more fuel tanks.

BACKGROUND OF THE INVENTION

This invention pertains to a fuel dispensing nozzle for dispensing of fuel, fuel additives, or different fuels, or fuels of different grades, octanes, types, other liquids, or the like, with the nozzle having dual spouts, extending from the nozzle housing, and having separate flow paths extending through the nozzles for dispensing discrete fuels or additives through their separate spouts, into one or more fuel tanks, or the like.

As is well known in the art, and which has been available for years, different grades of fuel, usually at various octane ratings, are readily available for dispensing at service stations. In addition, there are a few other grades and types of fuels that can be dispensed, whether it be diesel, ethanol, or a few other types of fuel that are currently being researched, and even fuels that may need to be combined with additives, such as gasoline and ethanol, diesel and biodiesel, to provide for either the separate dispensing into individual fuel tanks, or for their blending into a singular fuel, upon dispensing into the vehicle, or other fuel storage tanks.

As an example of technology relating to this type of use of fuels, and their dispensing, such can be seen in the published application to the assignee herein, US 2018/0057349-A1, which shows and describes a custom blending manifold for mixing of various fuels for fuel dispensing system. That particular disclosure shows means for blending various fuels and additives, such as diesel and biodiesel, gasoline and ethanol, which are blended together within a manifold, provided within the fuel hose leading to the nozzle, for a fuel dispensing system.

The published application to Larsson, No. US 2016/0083243, shows another fuel blending hose and fuel dispensing unit, wherein the separate fuel lines may be coaxial, delivering the combined fuel into an aligned or third fuel line, when delivering the fuel to its nozzle for dispensing.

Other patents that show devices for mixing and dispensing of two flowable materials can be seen in U.S. Pat. No. 6,105,822, to Larsen, et al, and it is upon a device and method for mixing and dispensing two flowable materials. U.S. Pat. No. 7,114,523, to Ricciardi, et al., shows an apparatus for mixing two fluids or keeping them separate. In addition, U.S. Pat. No. 6,926,030, also to Ricciardi, et al., shows a further apparatus for mixing two fluids or keeping them separate.

A patent to the assignee herein, is the U.S. Pat. No. 6,634,395, upon a double poppet valve for precise shut off of a fuel dispensing nozzle. This is a double poppet valve, but not separate poppet valves, as considered for the subject matter of this current development.

A further patent to the assignee herein, U.S. Pat. No. 5,197,523, shows a dispensing nozzle improvement, but it shows a coaxial type of fuel hose, one for delivering fuel to the nozzle, and the other for vapor return. But, the nozzle only shows a singular spout.

U.S. Pat. No. 4,351,375 shows what is identified as a dual spout dispensing nozzle, but actually this is a coaxial type of spout, apparently one for delivering fuel, and the other for vapor return, all within the same dispensing spout.

U.S. Pat. No. 9,849,775, shows a filler neck for an auxiliary liquid reservoir. This is a quite different structured filler neck, it has an auxiliary liquid reservoir for a motor vehicle, such as for a urea reservoir.

U.S. Pat. No. 6,158,631, shows a structured type of dispenser gun wherein the spouts are positionable upon the identified gun handle. It appears that there is a singular dispenser that can be pivoted to a variety of positions relative to its identified handle.

U.S. Pat. No. 8,631,837, shows a cross section of the various components that make up the standard fuel dispensing nozzle, including its handle, lever, poppet valve, automatic shut off, and its singular dispensing spout.

A variety of other patents show the use of dual spouts upon containers, such as can be seen in design U.S. Pat. No. D542,139, identified as a dual spout bottle.

U.S. Pat. No. 6,520,383, shows a vessel with dual pour spouts.

Design Pat. No. 420,908, shows what appears to be a milk carton, with dual spouts.

U.S. Pat. No. 5,289,856, shows a multi-purpose nozzle with liquid pickup. U.S. Pat. No. 6,951,229 discloses a nozzle including first and second lever portions.

U.S. Pat. No. 6,460,526, shows a dual tank simultaneous fill system.

These are examples of various types of fluid and fuel dispensing nozzles, or other type of structured vessels having dual spouts.

SUMMARY OF THE INVENTION

This invention relates generally to dispensing nozzles, and more particularly, to a specifically structured formation for a fuel dispensing nozzle, one that is capable of dispensing separate fuels or additives from the dual spouts integrated into the front of the nozzle housing, with the nozzle housing having separate flow paths provided therethrough, for the different fluids, with separate controls for each flow path in the category of a poppet valve, and an automatic shut off valve, that is operatively associated with each of the fuel dispensing spouts. Such a nozzle, with dual spouts, can be used for delivery of diesel fuel, and urea or biodiesel fuel additive, or can deliver separately gasoline and ethanol, at controlled rates and volumes, or can be used for blending various fuels together, as the fuels or their additives are separately delivered to one or more fuel tanks, during usage of this invention.

The invention contemplates the application of a nozzle handle, that can have an inner flow path and an outer flow path, leading from the fuel entrance at the back end of the handle, and the front end of the handle has the operating mechanisms that provide control for a poppet valve associated with each of the flow paths, and the automatic shut off systems each which is operatively associated also with each said flow path, and then forwardly of the handle is the pair of spouts that provide for delivery of the separate fuels from the respective pair of flow paths, when dispensing fuel or its additives to a fuel tank or other storage container. The handle includes its overall housing, which also has an operating actuating lever towards the bottom of the handle, and which operating lever when lifted upwardly provides for opening of one or both of the poppet valves, to provide for fuel flow. The operating lever, at its front end, is pivotally connected with the bottom stem of the automatic shut off means, which is of the type that is normally used in fuel dispensing nozzles, and which for many years has dispensed a single type of fuel, through the nozzle, out of its spout, and into the fill pipe of the vehicle gasoline tank. The actuating lever for the handle can also include the usual latch mechanism, that holds the handle open, until the automatic shut off valves are released, due to the operations of the venturi valves that locate at the front end of the nozzle housing, and are usually disposed at the entrance into the spouts, as known. The venturi valves operate under the flow of fuel, to create a vacuum, which normally is dissipated through the opening of the vacuum line that extends to the approximate front tip of the nozzle spouts, but that when a fuel filled condition is encountered that blocks the entrance of atmosphere into the vacuum lines, allows for initiating the shut off of the nozzle, through release of one or more of its automatic shut off valves, that drops the valve stems downwardly, and releases the actuating lever from biasing the poppet valves open, and closes said poppet valves, thereby curtailing the further flow of gasoline or other fuel through the nozzle, for delivery out of one or both of its spouts.

Each actuating lever, at its forward portion, pivotally connects with its yoke, that further pivotally connects at its front end to the stems of the plunger for the automatic shut off valves, as will be described in detail subsequently herein. Thus, when the plunger for the automatic shut off valve is dropped, when the vacuum generated from fuel flow lifts the diaphragm of the shut off valve, the actuating lever descends, that allows for the stems of the poppet valves to likewise drop, closing off one or more of the poppet valves for this fuel dispensing nozzle, upon completion of a fueling operation. The yoke portion of the actuating lever are independently operative with respect to said lever, and at its forward end includes a transfer pin that biases against each of the independent actuators, to allow for one or both to be activated, for opening of their respective associated poppet valves, and to allow for the flow of fuel or additives through the respective flow paths of the nozzle, during its usage. The transfer pin can be disposed for engaging one or both of the separate actuators, depending upon whether one or both of the fuels are to be dispensed, simultaneously, or alternatively, in the usage of the co-fueling nozzle of this invention.

It is, therefore, the principal object of this invention to provide a co-fueling nozzle, having a pair of flow paths provided extending through the nozzle housing, and its handle, for delivering, independently, separate fuels or additives for dispensing out of their discrete nozzle spouts provided at the front end of the nozzle and during their dispensing.

Another object of this invention is to provide a co-fueling nozzle, wherein each flow path through the nozzle has its own independent poppet valve, and automatic shut off valve, cooperating with its respective nozzle spout, to provide for opening of the poppet, to allow dispensing of fuel therethrough, until such time as the automatic shut off valve or handle release initiates closure of that flow path.

Another object of this invention is to provide a nozzle that can dispense a plurality of fuels, or fuel additives, through manipulation of a single actuating lever, to provide for dispensing of such fluids either simultaneously, or alternatively, depending upon the type of dispensing desired from the fuel dispensing nozzle, as selected by its operator.

Still another object of this invention is to provide a fuel dispensing nozzle wherein its actuating lever can operate two separate yokes, or actuators, through a positioned transfer pin, to allow for the activation of one or both of the associated poppet valves, for dispensing one or more fluids through the associated nozzle, and into one or more of a fuel storage tank, or the like.

A further object of this invention is to provide a uniform structure for a fuel dispensing nozzle, to provide for co-fueling, so as to allow for blending of fuels or additives delivered from separate nozzle spouts, integrated into the structure of the fuel dispensing nozzle of this invention.

Still another object of this invention is to provide a uniquely styled fuel dispensing nozzle, having dual spouts for co-fueling of a vehicle, that may provide for blending of various fuels together, at a predetermined mixture, when delivering such fuels or additives to the vehicle being filled.

Yet another object of this invention is to provide a fuel dispensing nozzle, having co-fueling spouts, for use for blending of fuel within a vehicle fuel tank.

Another object of this invention is to provide a blending system for a fuel dispensing nozzle, that may blend various grades, different octane ratings, or even different styles and types of fuels, or additives, together, as they are delivered into the fill pipe of a vehicle during fill up.

Yet another object of this invention is to provide a blending fuel dispensing system that incorporates a nozzle having dual spouts, for co-fueling of a vehicle, and that may be used in the blending of fuels for any type of vehicle, whether it be an automobile, truck, farm equipment, boats, airplane, and even other types of vehicles.

These and other objects may become more apparent to those skilled in the art upon review of the summary of the invention as provided herein, and after undertaking a study of the description of its preferred embodiment, in view of the drawings.

DESCRIPTION OF THE PREFERRED EMBODIMENT

Figure 1:
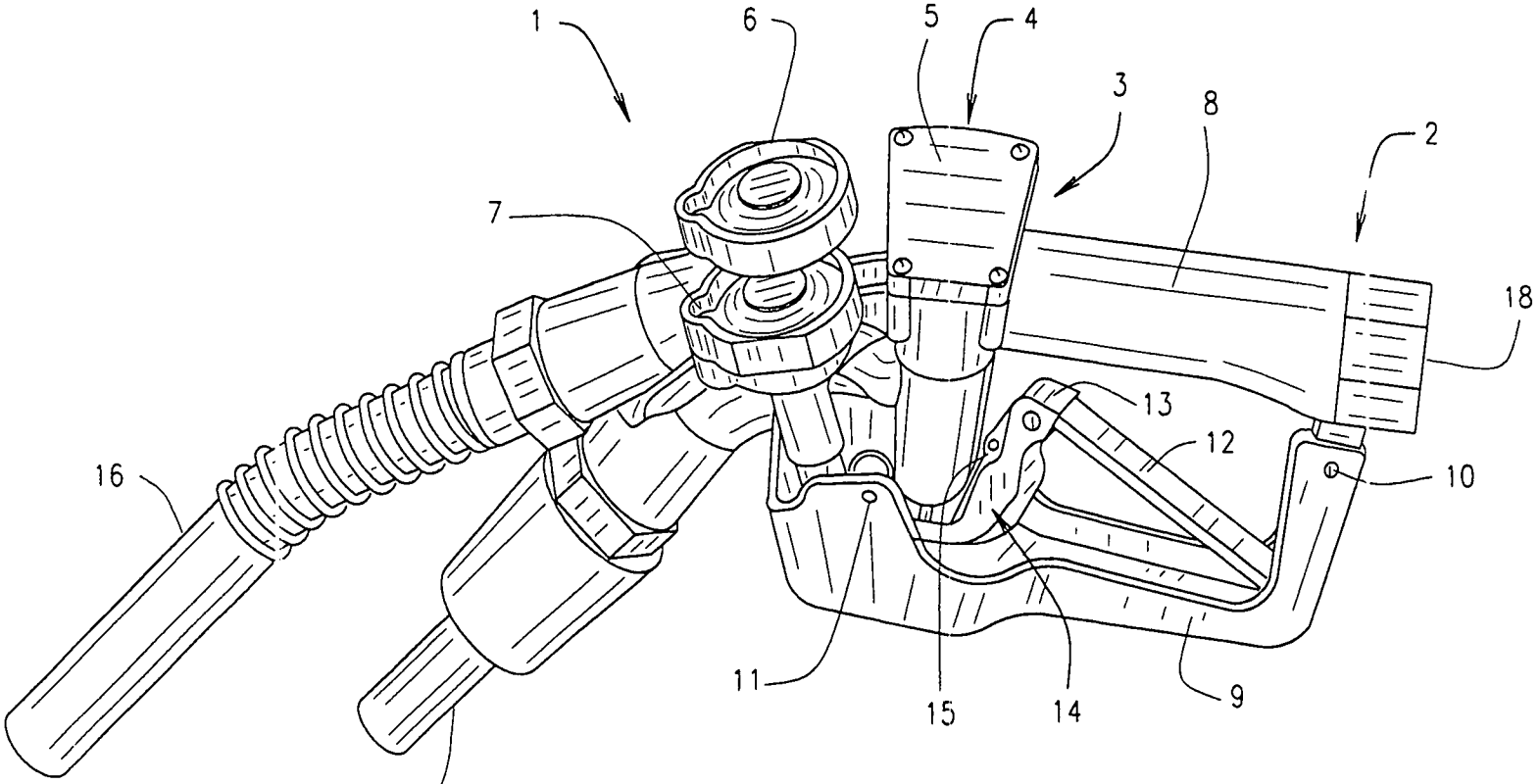
FIG. 1 provides a perspective view of the co-fueling dual spout nozzle of this invention.

In referring to the drawings, and in particular FIG. 1, the co-fueling nozzle with dual spouts 1 is disclosed. As noted, the nozzle 2 has its housing portion 3, that includes the area where the poppet valves 4 locate, under their cap 5 and forwardly thereof the housing embodies the automatic shut off mechanisms 6 and 7, one each operatively associated with the dual flow lines that are provided through the co-fueling nozzle, of this invention. The nozzle handle 8 includes the dual flow paths, for the fuel or additives, as will be subsequently described, and the handle secures the handle guard 9 as at the location 10, at its back end, and which guard secures to the housing, at the location 11. A single actuating lever 12 pivotally connects, at the pivot point 13, with a pair of yokes 14, the yokes forming a pair of independent actuators, as at the location 15, as will be subsequently described. These actuators bias against the poppet valve stems, as will be later described, when the actuating lever 12 is lifted, to provide for opening of the nozzle, to allow fuel and additive to flow, and independently pass through their respective flow paths, for dispensing out of the dual spouts 16 and 17, as can be noted.

As further known, the fuel flow line or hose (not shown), will be secured within the back end of the handle 2, as at the location 18.

Figure 2:
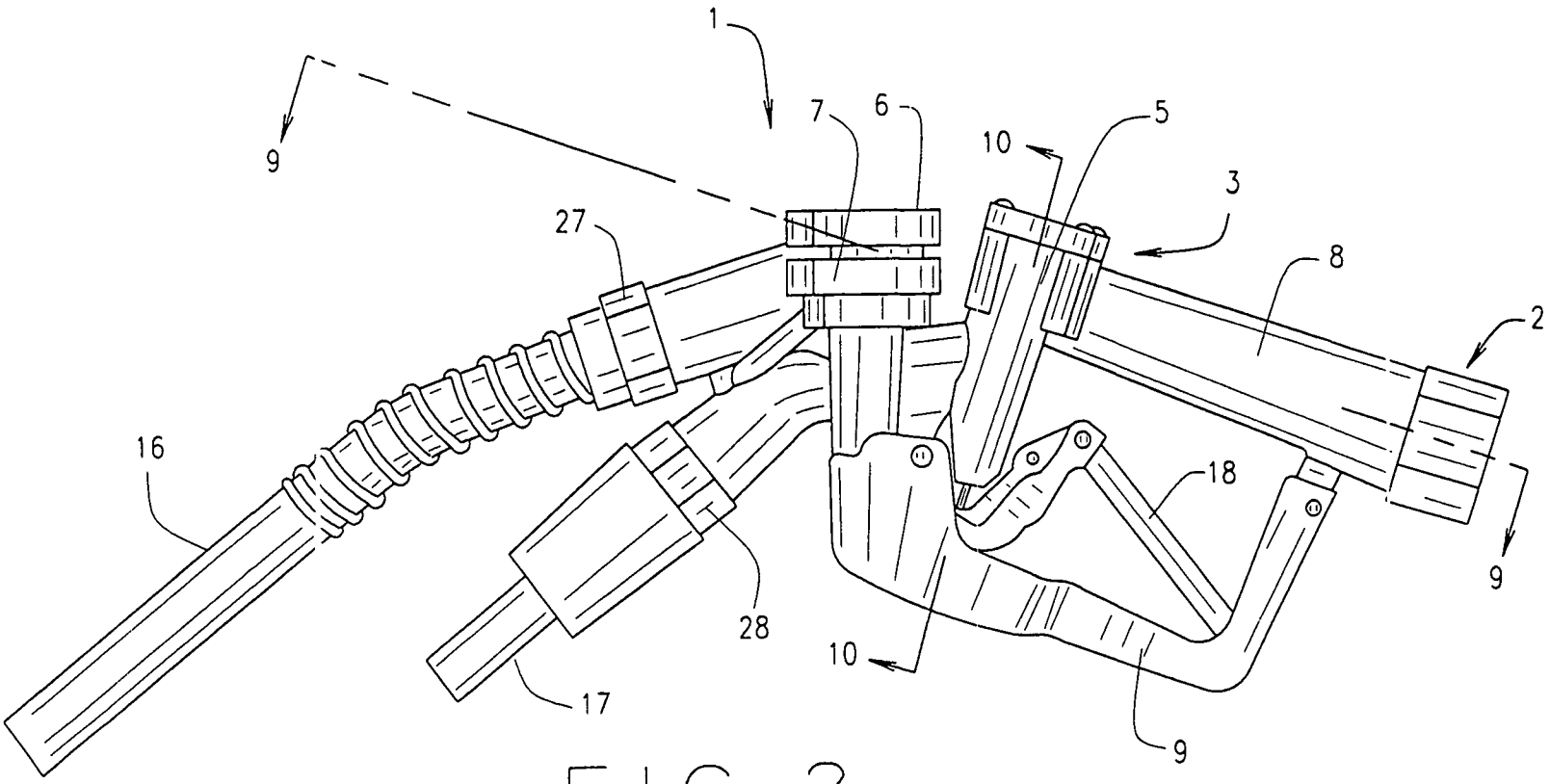
FIG. 2 is a left-side view thereof.
Figure 3:
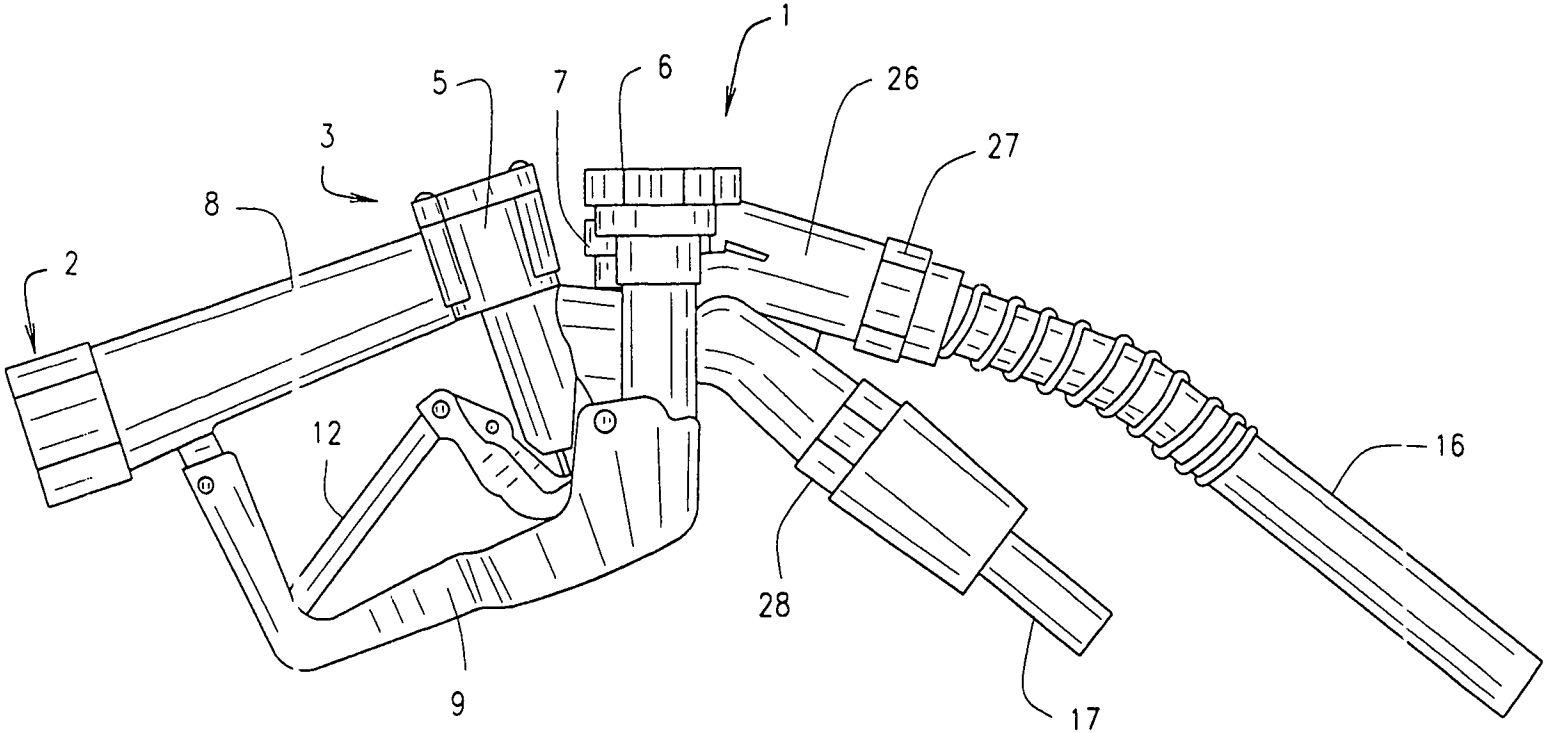
FIG. 3 is a right-side view.

The various side views of the nozzle 1 is depicted in the figures as disclosed in said FIGS. 2 and 3.

Figure 4:
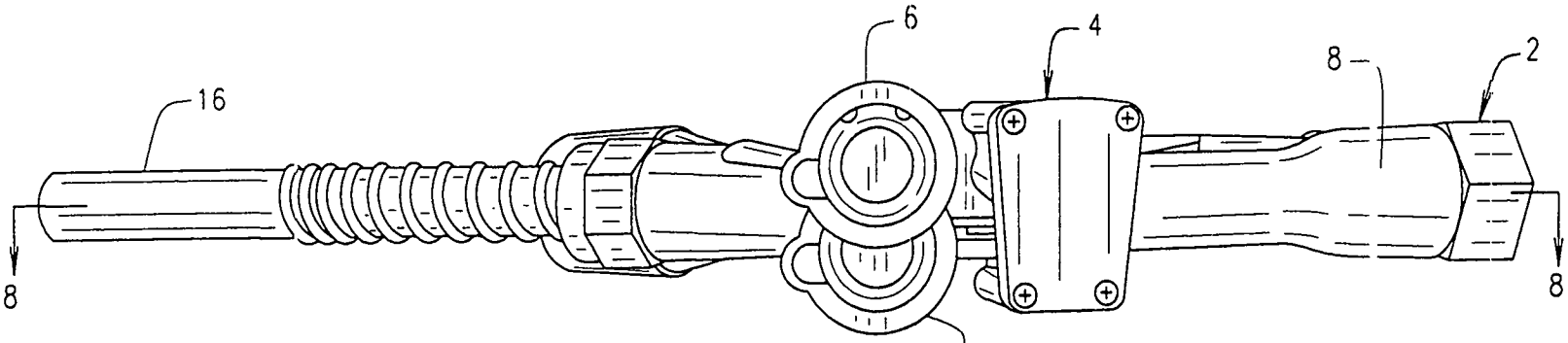
FIG. 4 is a top view.
Figure 5:
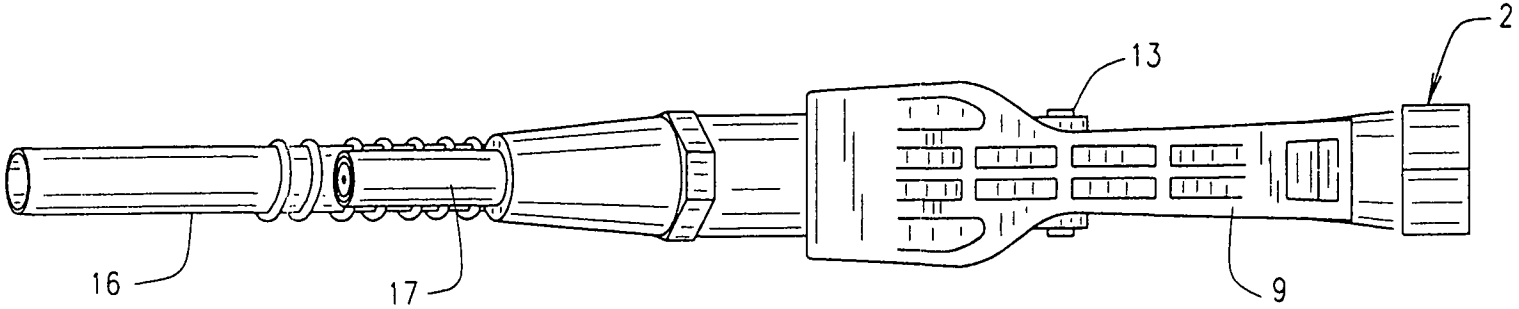
FIG. 5 is a bottom view.

In addition, the top view of the co-fueling nozzle as shown in FIG. 4, while the bottom view is disclosed in FIG. 5.

Figure 7:
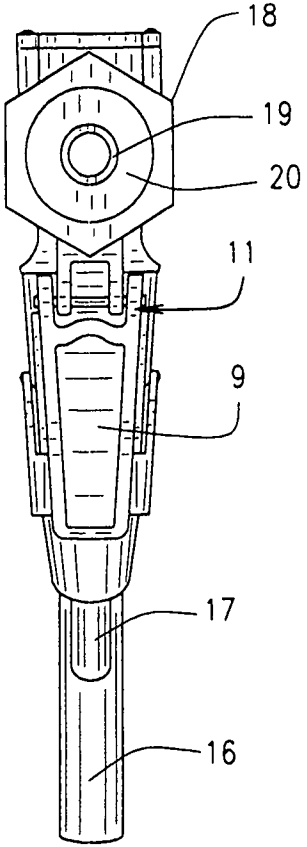
FIG. 7 is a back-end view.
Figure 6:
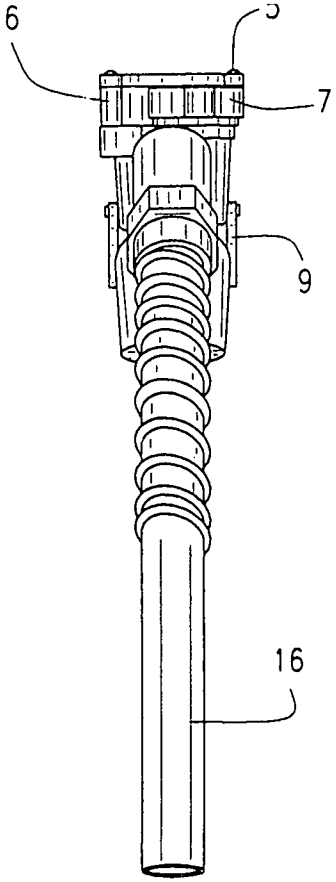
FIG. 6 is a front-end view of the nozzle.

Likewise, the front view of the co-fueling nozzle is disclosed in FIG. 6, while the rear view is shown in FIG. 7. As can be seen in FIG. 7, the back end 18 that connects with the fuel dispensing hose (not shown) delivers the separate fuels or additives through their separate flow paths, such as an inner conduit or flow path as noted at 19, while the outer flow path 20, at the entrance to the back end of the nozzle, can be seen.

Figure 9:
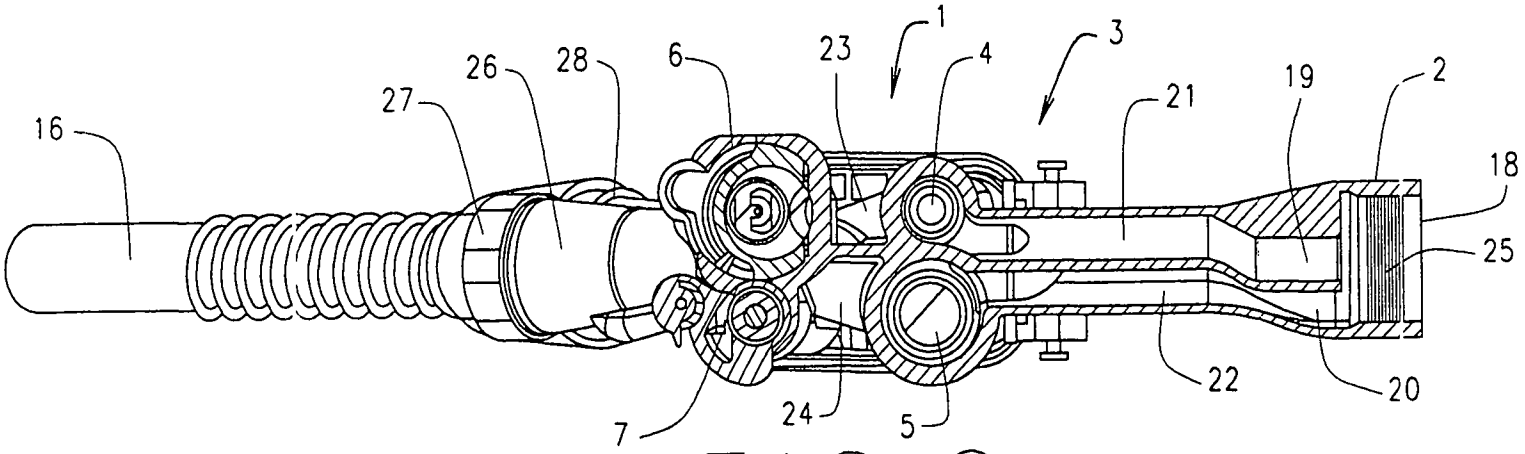
FIG. 9 is a partial sectional view of the upper part of the nozzle housing taken along the line 9-9 of FIG. 2.

A more detailed view of the internal operative mechanisms of the co-fueling nozzle 1 of this invention can be seen in FIG. 9. The inner flow path 19 can be seen, and relates to the inner flow path as previously described in FIG. 7. That flow path diverts to one side, as noted at 21, and encounters its associated poppet valve 4 as previously explained. The outer flow path 20, as previously explained with respect to FIG. 7, extends to the left side, as flow path 22, as can be noted, and it encounters its poppet valve 5, as previously explained. When one or both of the poppet valves 4 or 5 are opened, as will be subsequently described, the fuel or additive can continue its flow through the separate flow paths 23 and 24, respectively, and cooperate with their associated automatic shut off valves 6 and 7, as can be seen.

As can also be noted, at the back end 18 of the handle 2, there are threads, as generally noted at 25, into which the fitting at the end of the fuel dispensing hose (not shown), or the nozzle swivel, engages, when securing the fuel line to the nozzle in preparation for application and usage.

As can also be understood, the general structure of the various poppet valves 4 and 5, and the automatic shut off valves 6 and 7, are previously defined in the art, and one can take a look at the assignees' prior earlier U.S. Pat. No. 6,634,395, to see the structure and operation of these components, in their assembly and usage within a fuel dispensing nozzle, and in particular with a co-fueling dispensing nozzle of this invention. The definition of these components in said prior patent are incorporated herein by reference, to provide for a disclosure of the structure and operations of these components, within a dispensing nozzle.

Forwardly of the front 26 of the housing nozzle 3 is the spout nut 27 which in this case, secures the upper spout 16 in place, to the nozzle housing, when assembled. Obviously, there is a lower spout nut 28 that is applied for securement of the lower spout 17 (see FIG. 1) to the lower forward construction of the nozzle housing 3, as can be understood.

It should also be understood that while the particular nozzle spouts 16 and 17, as described herein, are shown as being aligned one over the other in the structure of the assembled nozzle, it is just as likely that these spouts could be assembled onto the nozzle housing body 3, side by side, and provide for the flow of their fuel or additive through the flow lines 21 and 22, and out of these horizontally aligned spouts, as can be understood. Obviously, the same spouts 16 and 17 can be at any angular relationship to each other, when assembled onto a nozzle housing, that is fitted to accommodate the attachment of a pair of spouts thereon, to achieve the co-fueling improvements of this invention.

Figure 10:
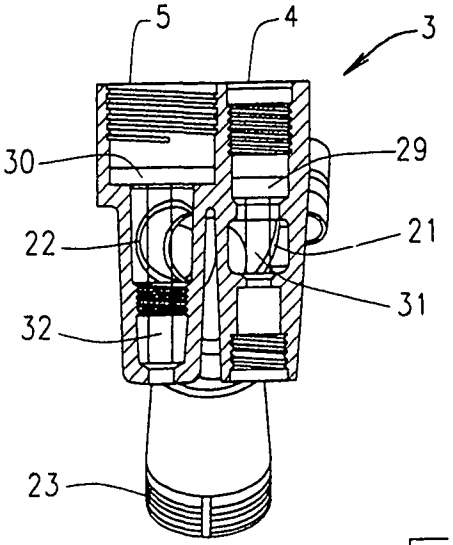
FIG. 10 is a vertical sectional view taken through the poppet structure of the co-fueling nozzle, taken along the line 10-10 of FIG. 2.

FIG. 10 shows a further sectional view of the nozzle housing 3, taken along that line 10-10 of FIG. 2, and generally is a sectional view taken through the poppet valves 4 and 5, as can be seen. The fuel flow paths, comprising the inner flow path 21 and the outer flow path 22 encounter their respective poppet valves 4 and 5, to prevent the flow or flows through the nozzle, when shut off, but that when the poppet valves 29 and 30 are raised, as the result of the actuating lever 12 of the nozzle handle being elevated, thereby pushing the valve stems 31 and 32 upwardly, to open their respective poppet valves 29 and 30, this then allows fuel to flow through their respective flow paths, and forwardly through the nozzle, and out their associated spouts, during a refueling performance. In this particular construction, as shown, the fuel passing through the outer flow passage 22 will be directed into the upper spout 16, for dispensing, while the inner flow path 21 directs its fuel or additive past the poppet valve 29, and out of the lower spout 17, during either simultaneous or alternate dispensing of their respective fuels or additives.

Figure 8:
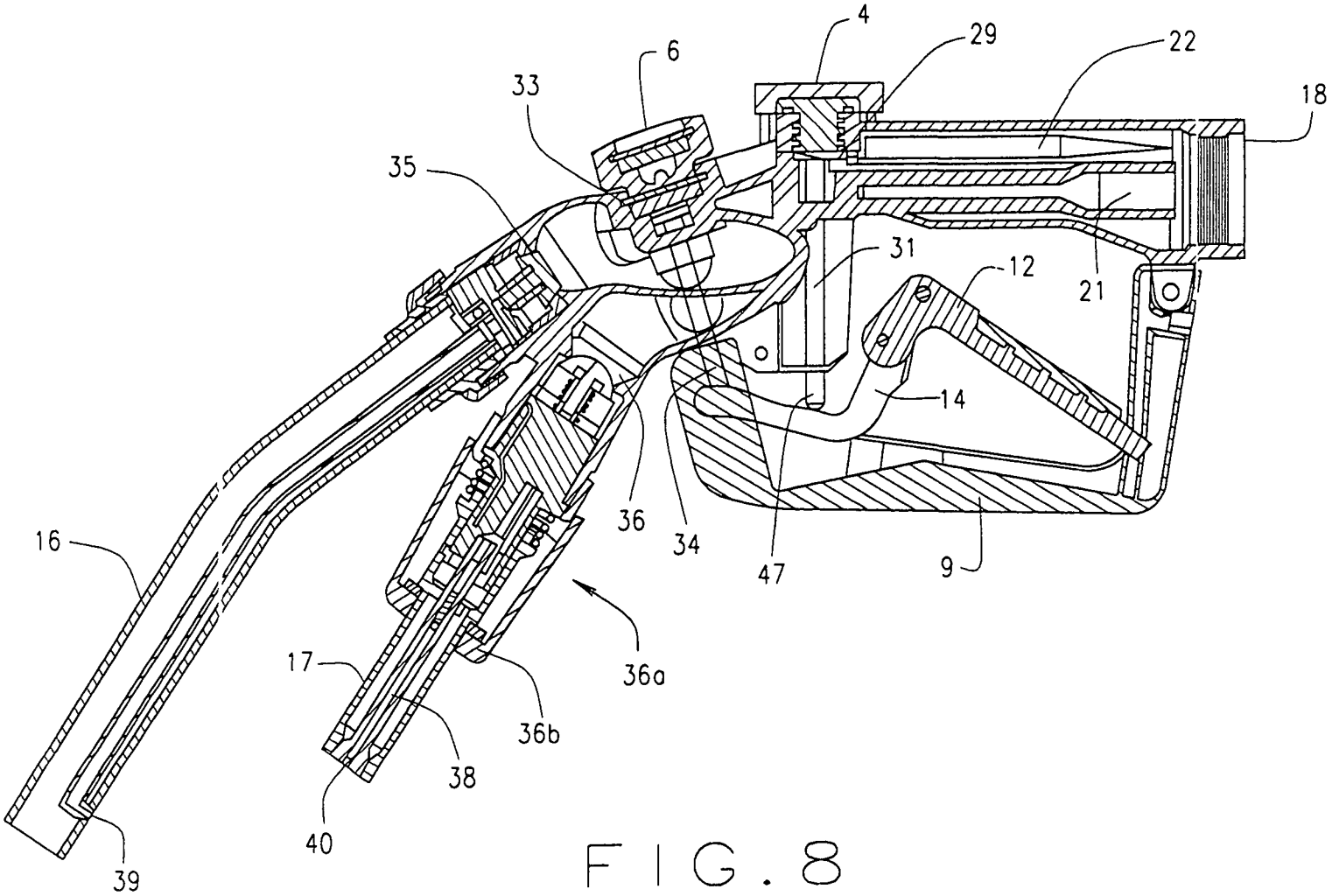
FIG. 8 is a sectional view taken along the line 8-8 of FIG. 4.

FIG. 8 discloses a sectional view taken along the line 8-8 of FIG. 4. And, it shows a side elevational section of the complete co-fueling nozzle, as can be noted. Its various components, as previously identified, are clearly disclosed.

In addition, as earlier summarized, the various automatic shut off valves 6 and 7, at least with respect to the valve 6, is shown in this FIG. 8. Its diaphragm 33 that cooperates with the suction pressure generated within the various nozzles to provide for shut off and curtailment of the further flow of fuel is shown, and its valve stem 34 is further noted, so that when the vacuum pressure generated from the venturi is blocked, because fuel reaches the tips of the nozzles, as noted, this allows the suction pressure generated by said venturi to elevate the diaphragm, and allow the automatic shut off stem 34 and its associated valve to descend, thereby allowing the poppet valves, such as 29, to lower, and close the further flow of fuel through the nozzle. This also has been previously shown and explained in the prior assignee U.S. Pat. No. 6,634,395. Since this is a sectional view, in FIG. 8, you only see the components of the automatic shut off valve 6. But, similar type components are provided for the automatic shut off valve 7, as can be understood.

As can also be seen, the various venturi 35 and 36 are also noted, and it is these venturi that generate the vacuum pressure needed to provide for functionality of the automatic shut off valves 6 and 7, as previously explained. As known in the art, when the venturi generate a suction pressure due to the flow of fuel through the nozzle, and out of their respective spouts, 16 and 17, in this instance, the vacuum pressure generated is relieved by means of its vacuum vent lines 37 and 38, as known in the art. But, when fuel or additive fills to completion within the one or more fuel tanks into which they are dispensing their gasoline or additives, and the fuel reaches the vent ports 39 and 40, then, as known, the further vacuum generated by the venturi elevate their respective diaphragms 33, this releases the shut off valve stems 34 to drop, lowering the actuators of the yoke 14 and its pivotally associated handle 12, to further descend, allowing the poppet stem 31 to descend, thereby closing off the poppet valve 29 or 30, for each of the poppet stems 4 and 5, to thereby shut off the flow of fuel through the co-fueling nozzle, for each of their respective fuel flow paths, as previously reviewed. There are actually two poppet stems, one for each of the poppets 4 and 5, which function independently to drop, when the actuating lever 12 is released, at the end of a fueling procedure.

As can also be seen, an interlock spout, as noted at 36*a*, is a component in the fuel dispensing industry that includes a spout that has a secondary opening/closing mechanism, as a back up, to the normal lever activation mechanism. This is sometimes required by the industry, as an additional safety feature. This secondary interlock mechanism is actuated by the act of inserting the nozzle into a vehicle fill neck. Typically, a collar, as noted at 36*b* provided around the exterior of the spout is depressed against the side of the vehicle as the spout enters the fill neck. There are multiple arrangements that can translate the action of depressing this collar into the opening of an internal valve in the spout, and interlock is a generic term that encompasses all of them. As shown, one of the two spouts of this design happens to be an interlock spout, but it is just as likely that such an interlock may not be integrated into the nozzle design, unless the customer specifies such.

Figure 11:
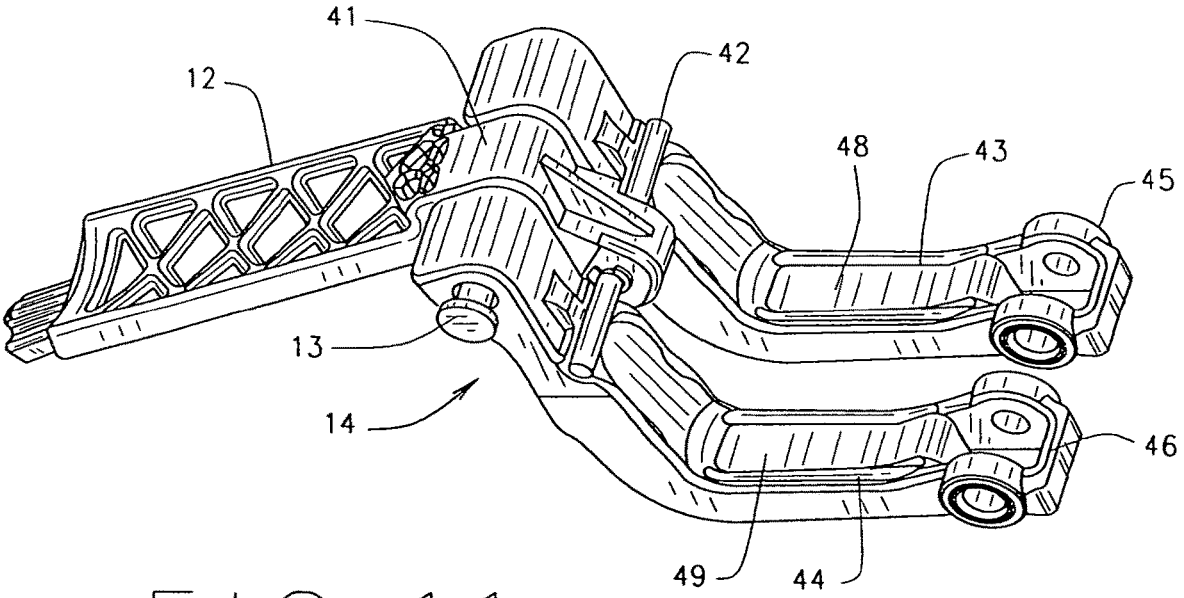
FIG. 11 is a perspective view of the operating yoke, and the independent actuators, for the handle structure of the nozzle with both of its actuators shown in their activated conditions.

This co-fueling nozzle is designed to provide for either simultaneously dispensing of its fuel or additive, through their respective flow paths, and out of their respective nozzle spouts, and this is achieved through the construction of the independent actuators that act in cooperation with the poppet stems 31, and 32, one for each poppet valve 4 and 5, and likewise cooperate with the shut off stems, as explained at 34, that can provide for the simultaneous flow of fuel or additive through the nozzle, or the independent flow of either gasoline or additive, through the nozzle, depending upon the fueling requirements for the vehicle being fuel serviced, during refilling. For example, FIG. 11 shows the actuating lever 12, its interconnection with the yoke portion 14 by way of its pivot pin 13, as previously explained with respect to the FIG. 1 embodiment. The actuating lever has its integrally extending forward portion 41, which mounts a motion transfer pin as can be seen at 42. Pivotally connecting forwardly of the single actuating lever 12, and pivotally mounted thereto, are the two independent actuators 43 and 44, of the yoke. Thus, when the handle is raised, comprising its actuating lever 12, the transfer pin 42 engages one or both of the independent actuators 43 and 44, and elevates those actuators, which raise their respective contact with the poppet stems, one as shown at 31, to elevate the poppet valves, and attain an opening for flow through the co-fueling nozzle. The forward ends of the independent actuators 43 and 44 pivotally mount at their front ends 45 and 46 to their respective shut off stems, one as shown at 34, to thereby provide for the initiating of the functioning of the automatic shut off valves, when these particular valves attain their operations, as previously explained, that allows the shut off valve stems, one as shown at 34, to drop, lowering one or more of their independent actuators 43 and 44, that allows the lower end of the poppet valve stems, one as shown at 31, to drop, to close off their respective poppet valves. The lower ends, one as shown at 47, in FIG. 8, normally bias upon their respective surfaces 48 and 49, of the independent actuators 43 and 44, as can be noted. The position of the actuating lever 12, operatively associated with its independent actuators 43 and 44, as shown in this FIG. 11, discloses these components as assembled within a nozzle provides for the simultaneously activating of their various poppet valves, to allow for flow of fuel and additive out of their respective spouts, at the same time.

Figure 12:
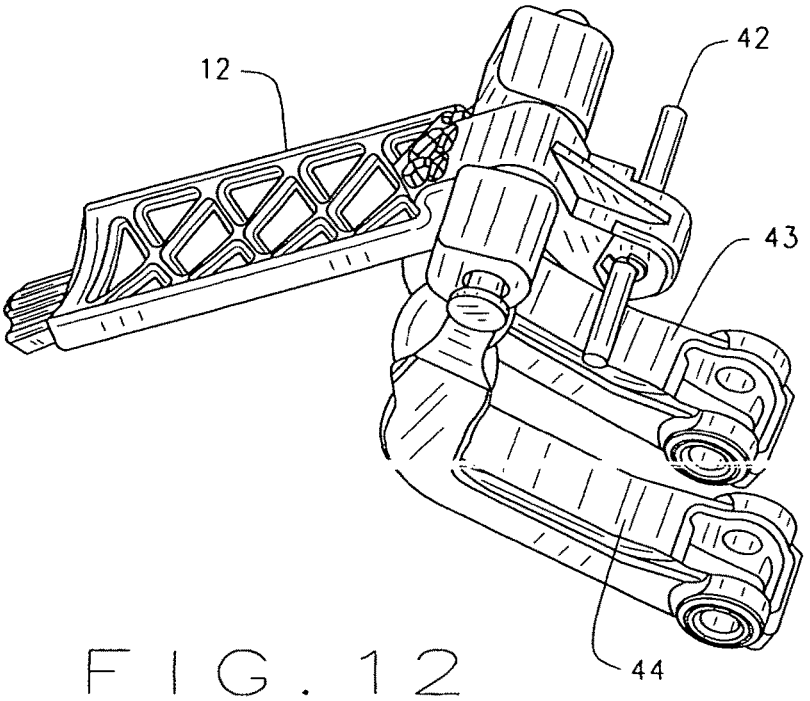
FIG. 12 is a further perspective view of the actuating lever and the independent actuators both shown in their inactive conditions.

As can be seen in FIG. 12, these same various components, such as the independent actuator 43 and 44, are disengaged from the transfer pin 42 of the actuating lever 12, and therefore, both of the independent actuators are deactivated, and thereby allow their respective poppet valve stems, and poppet valves, to remain in closure, curtailing the flow of fuel through either of the flow paths of the co-fueling nozzle.

Figure 13:
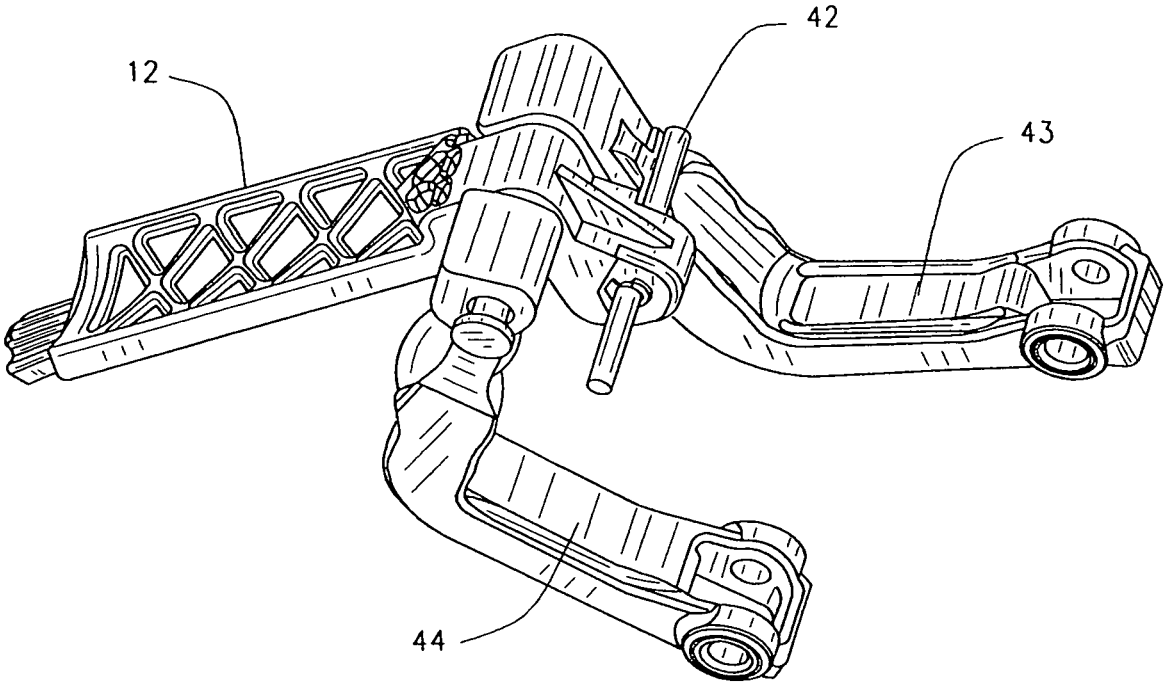
FIG. 13 shows the actuating lever maintaining through its transfer pin one of the independent actuators in an activated position, while the lower disclosed independent actuator is maintained inactive, allowing its associated poppet valve to remain closed, and preventing the flow of fuel through its associated flow path.

Alternatively, as can be seen in FIG. 13, the independent actuator 43 is engaged with the transfer pin 42, and thereby elevates said actuator for raising of its associated poppet stem 31, when the single grip actuating lever 12 is elevated. But, as can further be noted, since the transfer pin 42 is disengaged from the independent actuator 44, its associated poppet valve remains in closure, and does not allow the flow of any fuel or additive through its respective flow path, when maintained in this deactivated position. Thus, to reiterate, when the actuating lever 12 is raised, and elevates both of the independent actuators 43 and 44, as noted in FIG. 11, fuel can simultaneously pass through the flow paths of the nozzle, and out of their respective spouts. But, when the actuating lever 12 is released, allowing it to pivot downwardly, it disengages its independent actuators 43 and 44, allowing the poppet stems to descend to their fullest extent, thereby curtailing any further flow of fuel through the nozzle flow paths, as previously reviewed. This condition is as shown in FIG. 12. But, when only one of the independent actuators, such as the actuator 43, is raised, when the actuating lever 12 is elevated, to initiate fuel flow, it allows for fuel to pass through one of the flow paths of the nozzle, while the opposite independent actuator remains disengaged, and its associated poppet valve components remain closed, and under these circumstances, fuel will not flow through the poppet associated with the actuator 44, meaning that fuel will only flow through one path, but not the other flow path. This condition is as shown in FIG. 13.

Generally, this three part lever arrangement, as shown in FIGS. 11-13, are intended to allow for free rotational motion of the two actuators 43 and 44, independent of each other, until they come into contact with the pin 42, at which point they are forced to rotate simultaneously or identically. When the nozzle is activated, the lever 12 drives the two actuators 43 and 44 upwardly, via the pin 42. At this time, the actuators' is simultaneous and identical. When either of the two spouts automatically shut off mechanisms become activated, the corresponding plunger stem, when as shown at 34 for the automatic shut off valve 6, or the stem that is operatively associated with the automatic shut off valve 7, drop, and the corresponding actuator, 43 or 44, is driven downwardly and rotationally away from the pin 42, by the corresponding poppet stem, as at 47 with respect to the poppet 4, or the stem that is operatively associated with the poppet 5, as can be understood. As noted, since these operate independently, this is the condition as shown in FIG. 13, where the actuator 44 is being released, for being driven downwardly, and at this time, the motion of this actuator is independent of its fellow actuator 43. The remaining actuator 43 stays engaged until the shut off mechanism in its corresponding spout is also activated, and then it also pivots away from the pin 42, as can be understood. This condition is depicted in FIG. 12. The user then releases the lever 12, in the process of disengagement of the nozzle, and to replace it into its holster in the dispenser, as known in the art. When this occurs, both poppets are closed, and return to their normal positions, and the system is reset for the next usage.

The foregoing provides a detailed analysis of the various structures that are operatively associated in assembling the co-fueling nozzle of this invention.

Variations or modifications to the subject matter of this invention may occur to those skilled in the art upon review of the disclosure as provided herein. Such variations, if within the spirit of this invention, are intended to be encompassed within the scope of any claims to patent protection issuing upon this development. The detailed description of the invention in the specification, and its depiction in the drawings, are primarily set forth for illustrative purposes only.

We claim:

1. A co-fueling nozzle for dispensing fuels or additives through a singular nozzle to one or more fuel tanks, comprising:

a nozzle housing, a pair of fuel flow paths integrally provided through said nozzle housing;

said nozzle housing incorporating a handle, said nozzle housing having a back end and a forward end, and the entrance to the said pair of fuel flow paths being at the back end of said nozzle housing;

a pair of separate nozzle spouts provided at the forward end of said nozzle housing, and one of each of the pair of nozzle spouts communicating with one of the fuel flow paths, so that the separate fuel or additive entering each of its associated flow paths will flow out of its associated nozzle spout;

a pair of separate poppet valves provided in the nozzle housing, and one of each poppet valve being in one of the fuel flow paths provided through the nozzle housing, to independently control the flow of separate fuel through the nozzle for dispensing;

a pair of separate automatic shut-off valves operatively associated within the nozzle housing, one of each automated shut-off valve communicating within one of the fuel flow paths and provided when operative for the automatic shut-off of fuel flowing through the associated flow path when a fill condition has been encountered;

a pair of venturi valves, one of each venturi valve provided within each fuel flow line at the approximate entrance to the associated nozzle spout to cooperate with the automatic shut-offs to attain closure of its associated poppet valve when detecting the completion of the filing of the fuel tank into which it is dispensing its separate fuel or additive;

an actuating lever, operatively associated with the nozzle housing and its handle, said actuating lever provided for opening simultaneously or alternatively the pair of poppet valves to allow the flow of fuel or additives through the nozzle and into one or more fuel tanks;

each poppet valve has a stem extending therefrom, and said actuating lever contacting the bottom of each poppet stem such that when said handle and actuating lever is lifted, it provides for opening of one or both of the poppet valves for dispensing of its respective fuel or additive into one or more fuel tanks;

said actuating lever has a pair of actuators extending forwardly therefrom, and each actuator pivoting with the lifting of said lever to provide for the simultaneously or alternatively opening of the poppet valves to provide for dispensing of their selected fuels or additives during operation;

each actuator having a forward end, and each forward end of the actuators pivotally mounted to the bottom of their respective automatic shut-off valve such that the automatic shut-off valves are initiated, providing for the release of their respective actuators to provide for closure of its respect poppet valve to cease dispensing of fuel or additive through the flow path associated with that poppet valve to curtail further dispensing of fuel; and wherein said co-fueling nozzle may simultaneously or alternatively dispense fuel or additives through a singular separate nozzle in dispensing fuels from its associated spout to one or more fuel tanks.

2. The co-fueling nozzle of claim 1, wherein said fuel flow paths extend through the length of the handle of the nozzle housing to attain access of the fuel or additives to their respective poppet valves in preparation for dispensing of fuels or their additives.

3. The co-fueling nozzle of claim 2, wherein said nozzle is provided for separate dispensing of diesel and biodiesel fuels.

4. The co-fueling nozzle of claim 2, wherein said nozzle is provided for separate dispensing of gasoline and ethanol fuels.

5. The co-fueling nozzle of claim 2, wherein said nozzle is provided for the separate dispensing of diesel and urea.

6. The co-fueling nozzle of claim 2, wherein said nozzle is provided for the separate dispensing of blended fuels simultaneously or alternatively to one or more fuel tanks.

* * * * *